US007080526B2

(12) United States Patent
Papapanu

(10) Patent No.: US 7,080,526 B2
(45) Date of Patent: Jul. 25, 2006

(54) FULL PLATE, ALTERNATING LAYERED REFRIGERANT FLOW EVAPORATOR

(75) Inventor: Steven James Papapanu, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 61 days.

(21) Appl. No.: 10/752,976

(22) Filed: Jan. 7, 2004

(65) Prior Publication Data

US 2005/0144978 A1 Jul. 7, 2005

(51) Int. Cl.
*F25B 39/02* (2006.01)

(52) U.S. Cl. ..... 62/515; 165/166

(58) Field of Classification Search ..... 62/515, 62/115, 259.1; 165/165–167
See application file for complete search history.

(56) References Cited

U.S. PATENT DOCUMENTS

| | | | | | |
|---|---|---|---|---|---|
| 2,462,421 | A | * | 2/1949 | Pitt | 165/81 |
| 3,808,104 | A | * | 4/1974 | Davidson | 202/173 |
| 3,916,644 | A | * | 11/1975 | Nasser | 62/428 |
| 3,984,281 | A | | 10/1976 | Buchwald | 159/28 P |
| 4,002,201 | A | | 1/1977 | Donaldson et al. | |
| 4,270,602 | A | | 6/1981 | Foster et al. | |
| 4,572,766 | A | | 2/1986 | Dimitriou | 159/28.6 |
| 4,586,565 | A | | 5/1986 | Hallstrom et al. | 165/167 |
| 4,619,242 | A | * | 10/1986 | Smith | 126/110 R |
| 4,653,581 | A | * | 3/1987 | Yogo et al. | 165/166 |
| 4,706,741 | A | * | 11/1987 | Bolmstedt et al. | 165/115 |
| 4,762,171 | A | | 8/1988 | Hallstrom et al. | 165/147 |
| 4,821,531 | A | | 4/1989 | Yamauchi et al. | 62/515 |
| 5,076,351 | A | * | 12/1991 | Munekawa et al. | 165/104.21 |
| 5,172,759 | A | * | 12/1992 | Shimoya et al. | 165/110 |
| 5,435,383 | A | * | 7/1995 | Rajagopal | 165/167 |
| 5,462,113 | A | * | 10/1995 | Wand | 165/167 |
| 5,524,455 | A | * | 6/1996 | Hasegawa et al. | 62/513 |
| 5,609,036 | A | * | 3/1997 | Nagasawa et al. | 62/198 |
| 5,678,419 | A | * | 10/1997 | Sanada et al. | 62/205 |
| 5,823,252 | A | | 10/1998 | Waitkat et al. | 165/166 |
| 5,909,766 | A | * | 6/1999 | Kobayashi et al. | 165/70 |
| 5,930,894 | A | * | 8/1999 | Oikawa et al. | 29/890.047 |
| 5,984,000 | A | * | 11/1999 | Nakamura et al. | 165/153 |
| 6,241,011 | B1 | * | 6/2001 | Nakamura et al. | 165/153 |
| 2002/0020521 | A1 | | 2/2002 | Hoshino et al. | 165/174 |
| 2002/0079093 | A1 | | 6/2002 | Xiaoyang | |
| 2003/0070797 | A1 | | 4/2003 | Narahara et al. | 165/182 |

FOREIGN PATENT DOCUMENTS

| | | | |
|---|---|---|---|
| DE | 3147378 A | * | 6/1983 |
| EP | 1 160 530 | | 12/2001 |
| JP | 57140601 A | * | 8/1982 |
| JP | 9-113171 A | * | 5/1997 |
| JP | 10267427 A | * | 10/1998 |

* cited by examiner

*Primary Examiner*—Mohammad M. Ali
(74) *Attorney, Agent, or Firm*—Patrick M. Griffin

(57) ABSTRACT

An evaporator core for the climate control system of a motor vehicle formed from alternating pairs of plates. Each pair of plates includes two plates having a similar configuration engaged together and a mirrored, back-two-back relationship. Each of the plates includes at least one inlet aperture, an outlet aperture, and a return aperture. The structure of the plates and the arrangement of stacking produce an evaporator having a plurality of fluid pathways. Fluid is directed in alternating directions in adjacent pathways.

14 Claims, 18 Drawing Sheets

FULL PLATE, ALTERNATING LAYERED REFRIGERANT FLOW EVAPORATOR

TECHNICAL FIELD

The invention relates to a heat exchanger, and, more particularly, the invention relates to an evaporator for a climate control system of a motor vehicle.

BACKGROUND OF THE INVENTION

Despite advances in the design of automotive heat exchangers, the pressure is still strong for continued improvements, even in the face of demands for cost reductions. For evaporators, there are multiple needs, two of which are to reduce size and mass. Accomplishing this is a real challenge, since the cooling capacity and temperature uniformity should not be substantially compromised. Some designs presently in production accomplish this through increased complexity such as a multi-tank construction, adding fins on the refrigerant side, or manifold designs that utilize various sized orifices. Other designs presently in production use two-row extruded tube and center construction. While these designs have facilitated smaller heat exchanger design, the added complexity has increased the cost of producing the heat exchanger.

SUMMARY OF THE INVENTION

The present invention provides a method for manufacturing an evaporator including the step of connecting two similar plates in a back-to-back, mirrored relationship to form a first pair of plates. The method also includes the step of connecting another two plates in a back-to-back, mirrored relationship to form a second pair of plates. The plates that form the first pair are different than the plates that form the second pair. The method also includes stacking the pairs of plates together.

The plates include apertures that are aligned when the plates are connected in pairs and stacked together. The plates also include mounds formed around various apertures. The structural cooperation between the plates, the apertures in the plates, and the mounds form pathways for directing movement of a fluid stream. The fluid stream, such as a stream of fluid to be evaporated, can be directed in alternating directions in adjacent pathways.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
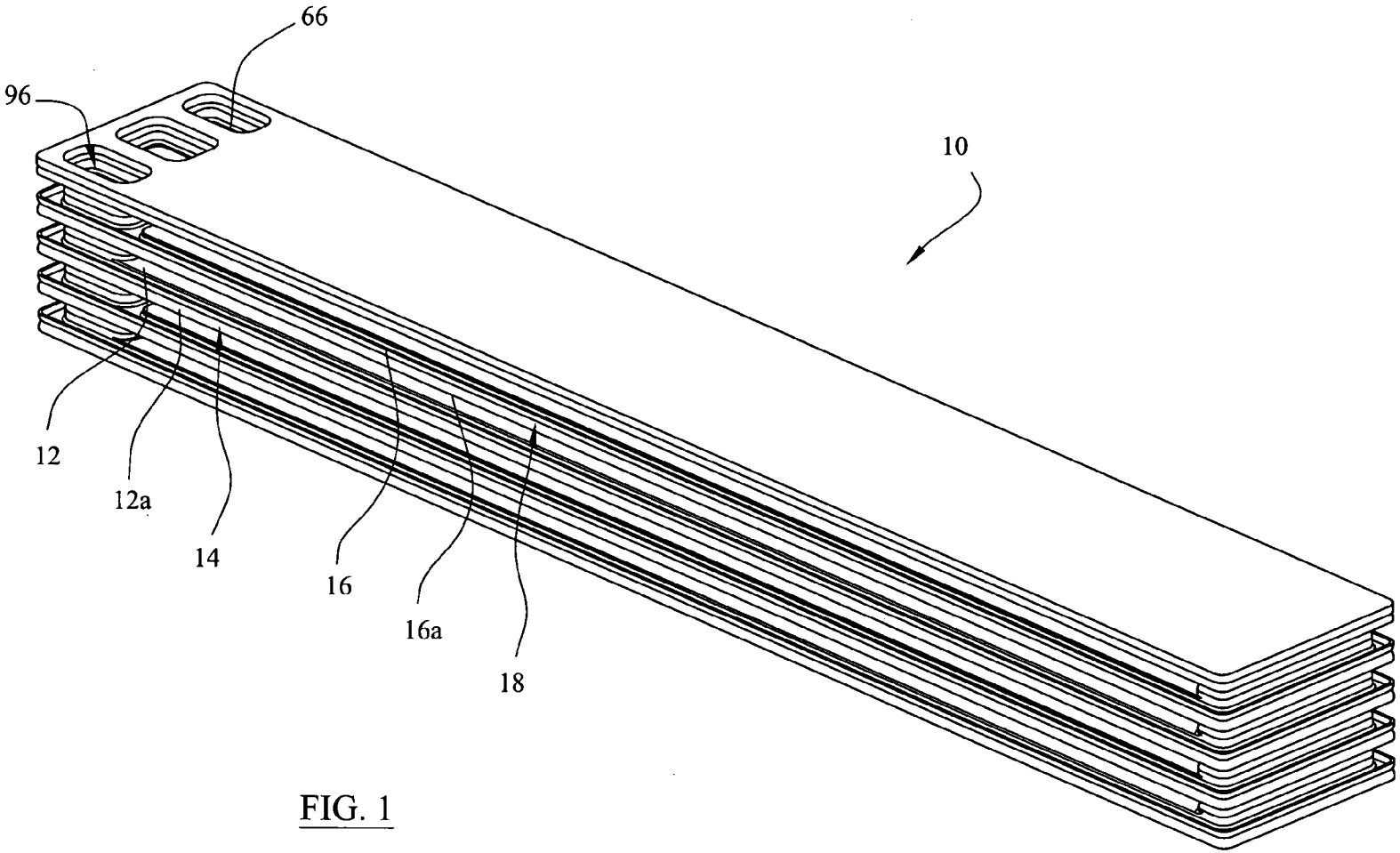
FIG. 1 is a perspective view of an evaporator according to an embodiment of the invention.

Various embodiments of the invention are shown throughout the several figures. Similar structure can be defined by alternative embodiments of the invention. Similar structural elements share a common reference numeral and are differentiated with an alphabetic designation.

Referring now to FIG. 1, the present invention provides an evaporator 10 including two first plates 12, 12*a*. Each of the first plates 12, 12*a* has a first configuration. The two first plates 12, 12*a* can be identical. The two first plates 12, 12*a* are engaged in a back to back mirrored relationship to one another to form a first pair 14. The evaporator also includes two second plates 16, 16*a*, having a second configuration and engaged in a back to back mirrored relationship to one another to form a second pair 18. The first pair 14 of plates 12, 12*a* and the second pair 18 of plates 16, 16*a* are stacked together. The first and second configurations are differently shaped from one another. The difference in the shape of the first and second configurations are best shown when comparing FIGS. 3 and 5, in particular the structure surrounding troughs 68 and 72.

Figure 2:
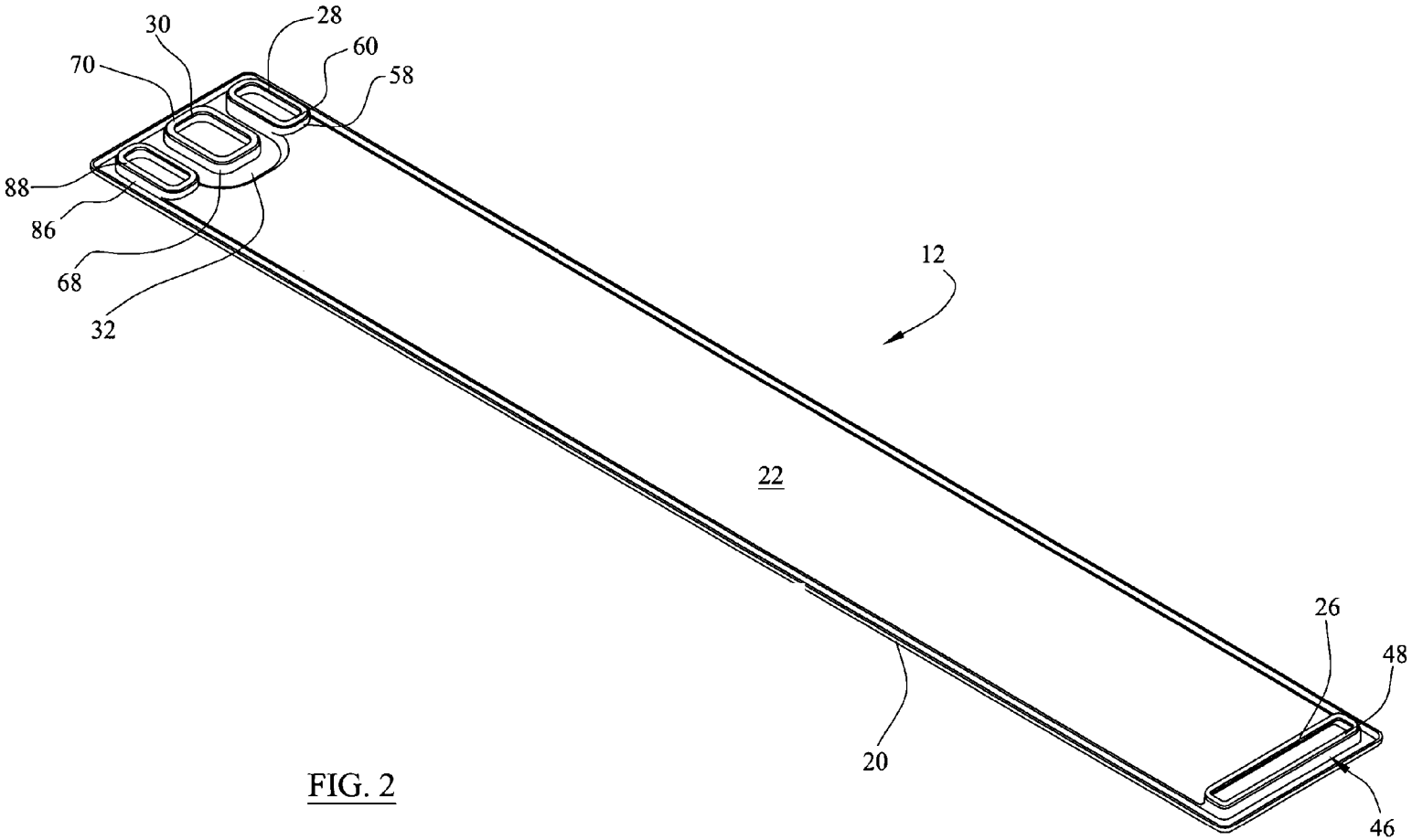
FIG. 2 is a perspective view of a first plate according to the invention.
Figure 6:
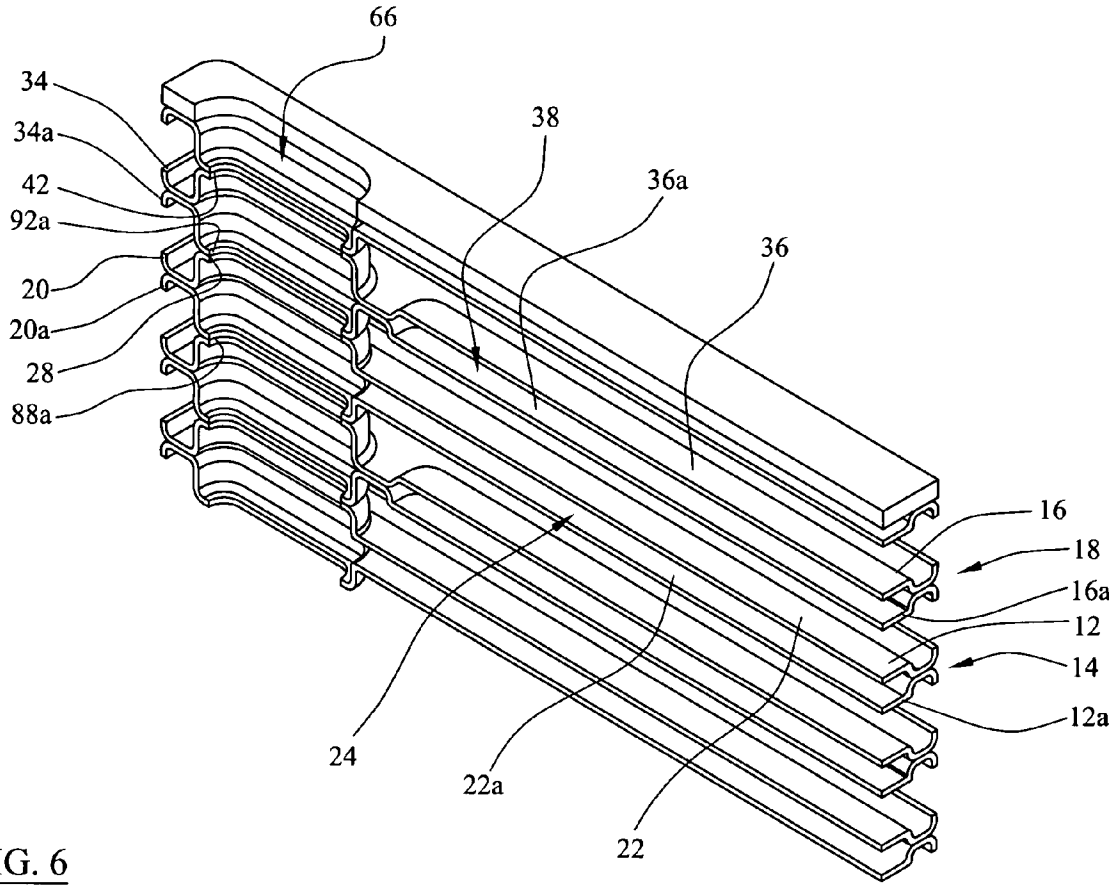
FIG. 6 is a perspective, staggered cross-sectional view of the evaporator shown in FIG. 1, the cross section taken along an inlet manifold of the evaporator.

Referring now to FIGS. 2 and 6, each of the first plates 12, 12*a* can include a first peripheral lip 20, 20*a* extending along the periphery of the respective said first plate 12, 12*a* and a first center portion 22, 22*a* recessed with respect to the respective peripheral lip 20, 20*a*. The peripheral lips 20, 20*a* of the two first plates 12, 12*a* can engage one another when the pair 14 is formed. The center portions 22, 22*a* can be spaced apart from one another when the first pair 14 is formed, defining a first cavity 24 between the first plates 12, 12*a*.

Figure 10:
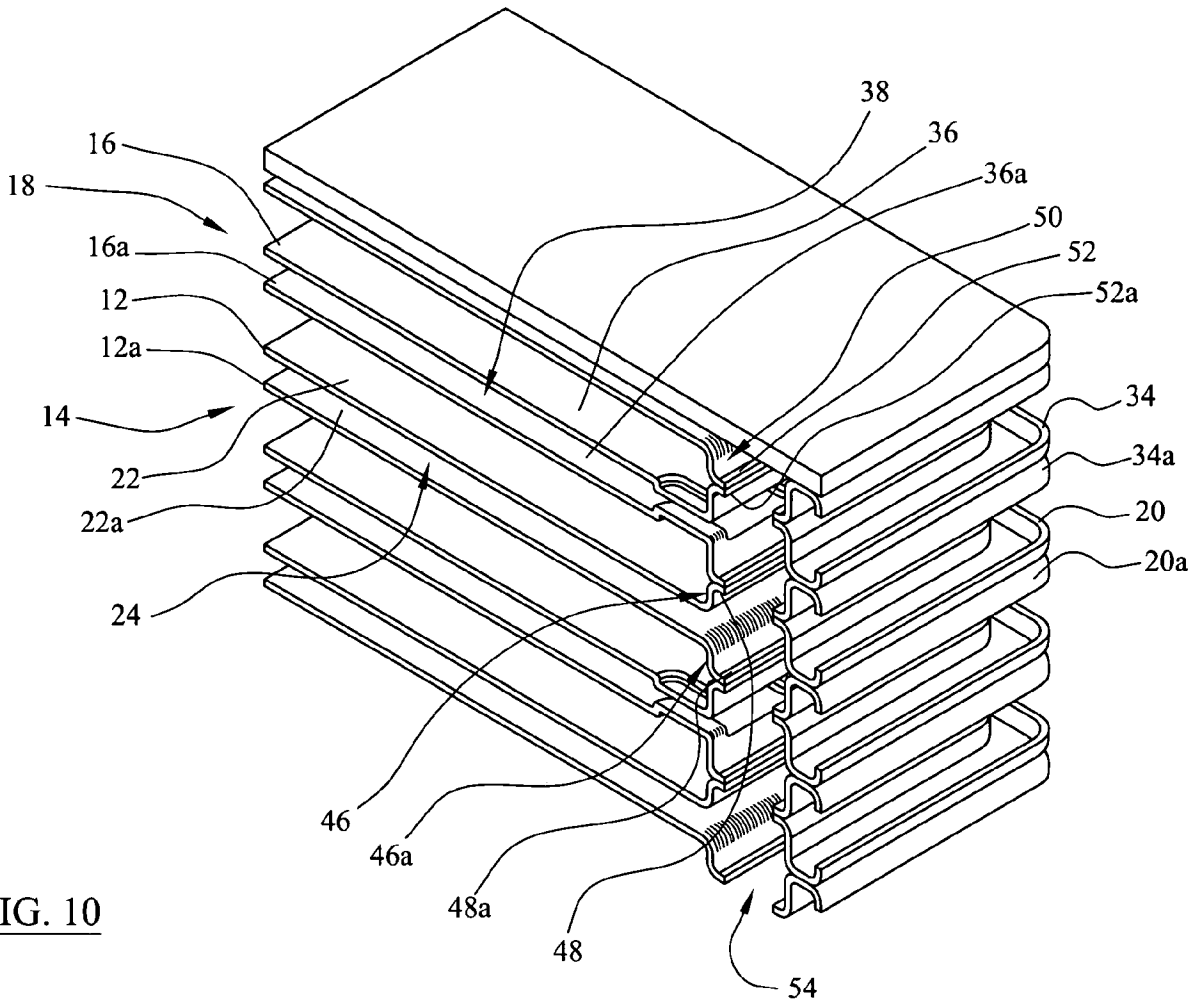
FIG. 10 is a perspective, partial cross-sectional view of the evaporator of FIG. 1 taken along the return tank.
Figure 11:
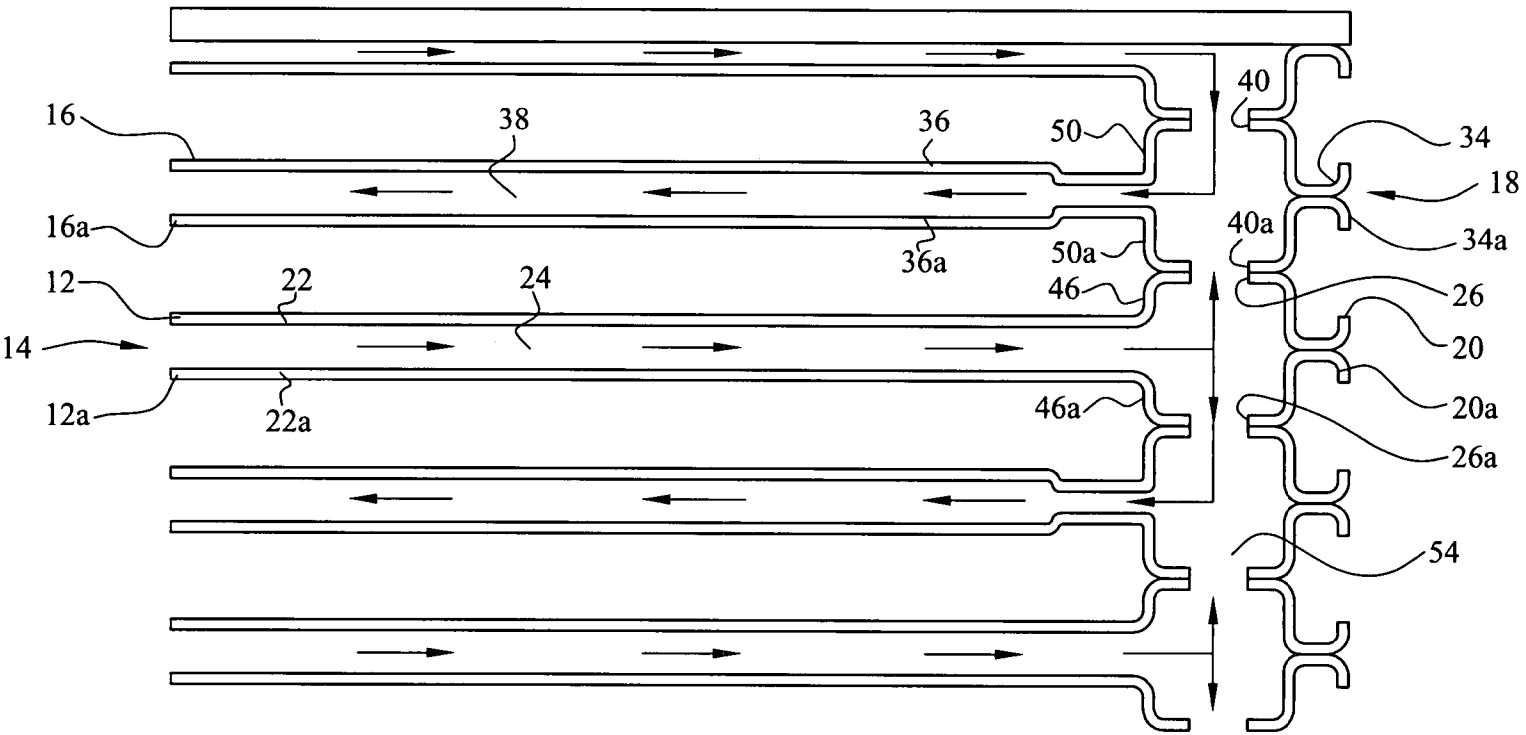
FIG. 11 is a side view of the cross-sectional view of FIG. 10.
Figure 12:
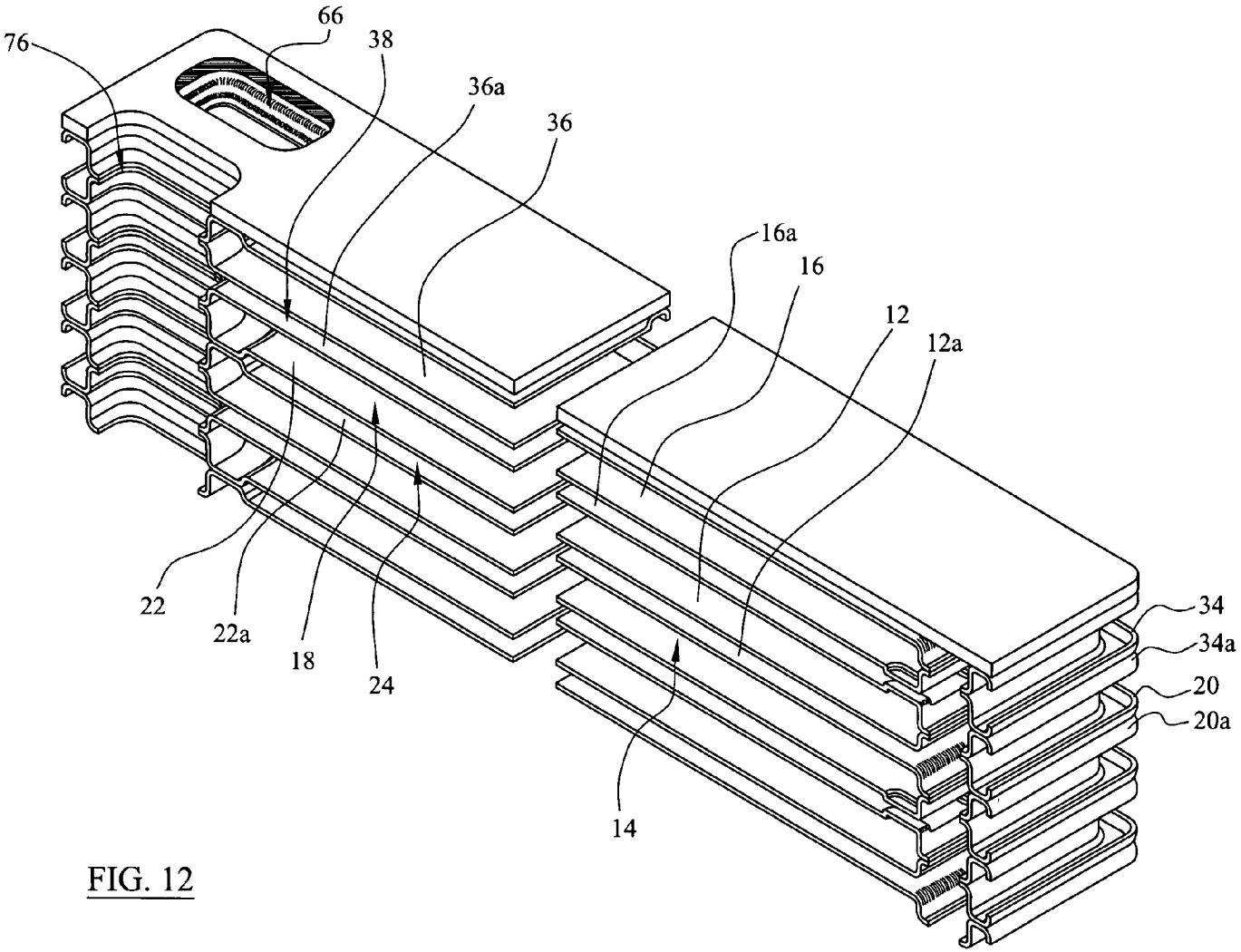
FIG. 12 is a perspective, broken cross-sectional view of the evaporator of FIG. 1 extending along the length of the evaporator.

Referring now to FIGS. 2, 10 and 11, each of the first plates 12, 12*a* can include first return apertures 26, 26*a* adjacent to the respective first center portions 22, 22*a*. The return apertures 26, 26*a* can communicate with the first cavity 24. Each of the two first plates 12, 12*a* can also include a first return trough 46, 46*a* recessed relative to the respective first center portion 22, 22*a*. The first return apertures 26, 26*a* can be individually disposed in respective bottoms 48, 48*a* of the first return troughs 46, 46*a*.

Figure 14:
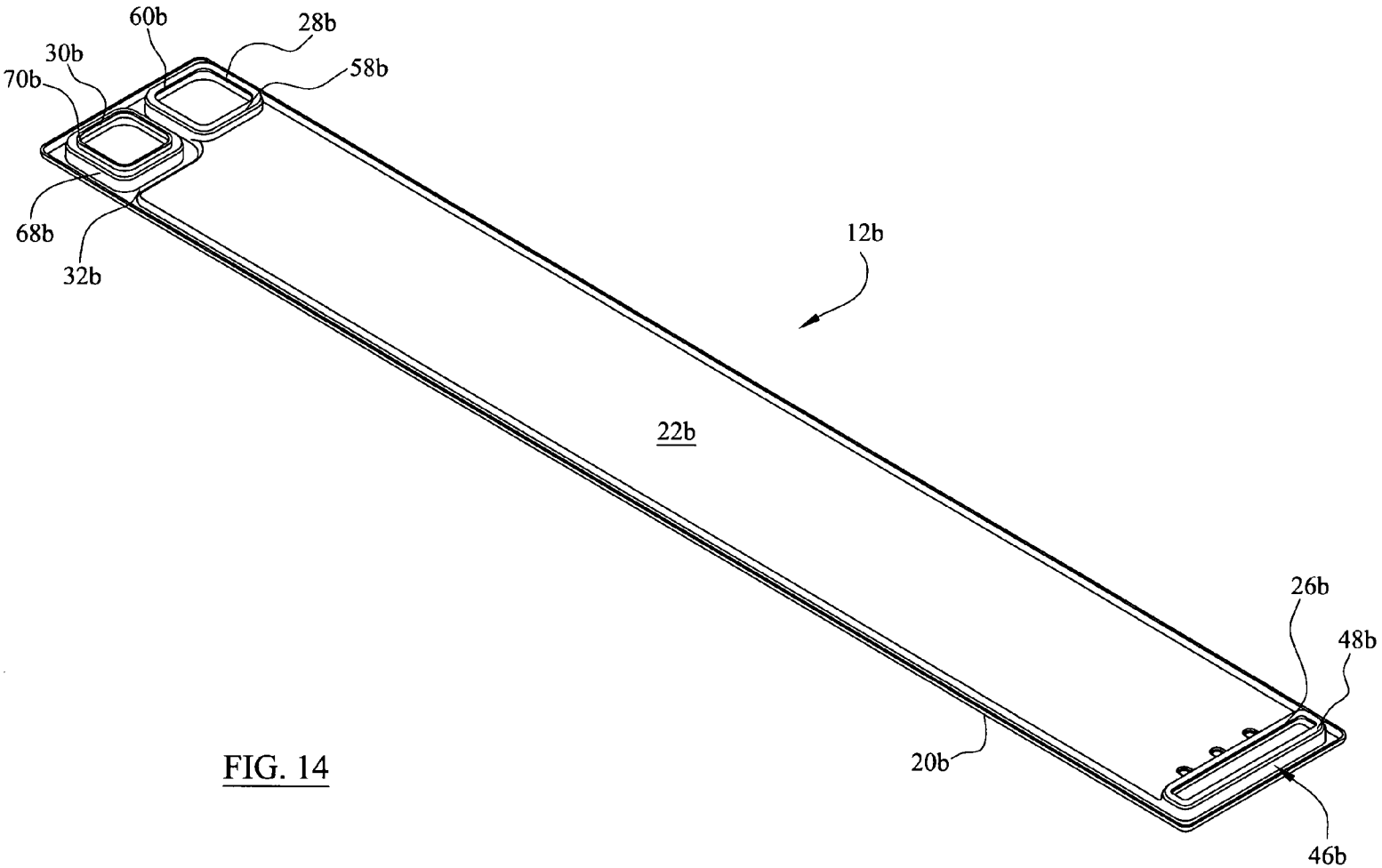
FIG. 14 is a perspective view of an alternate embodiment of a first plate.
Figure 15:
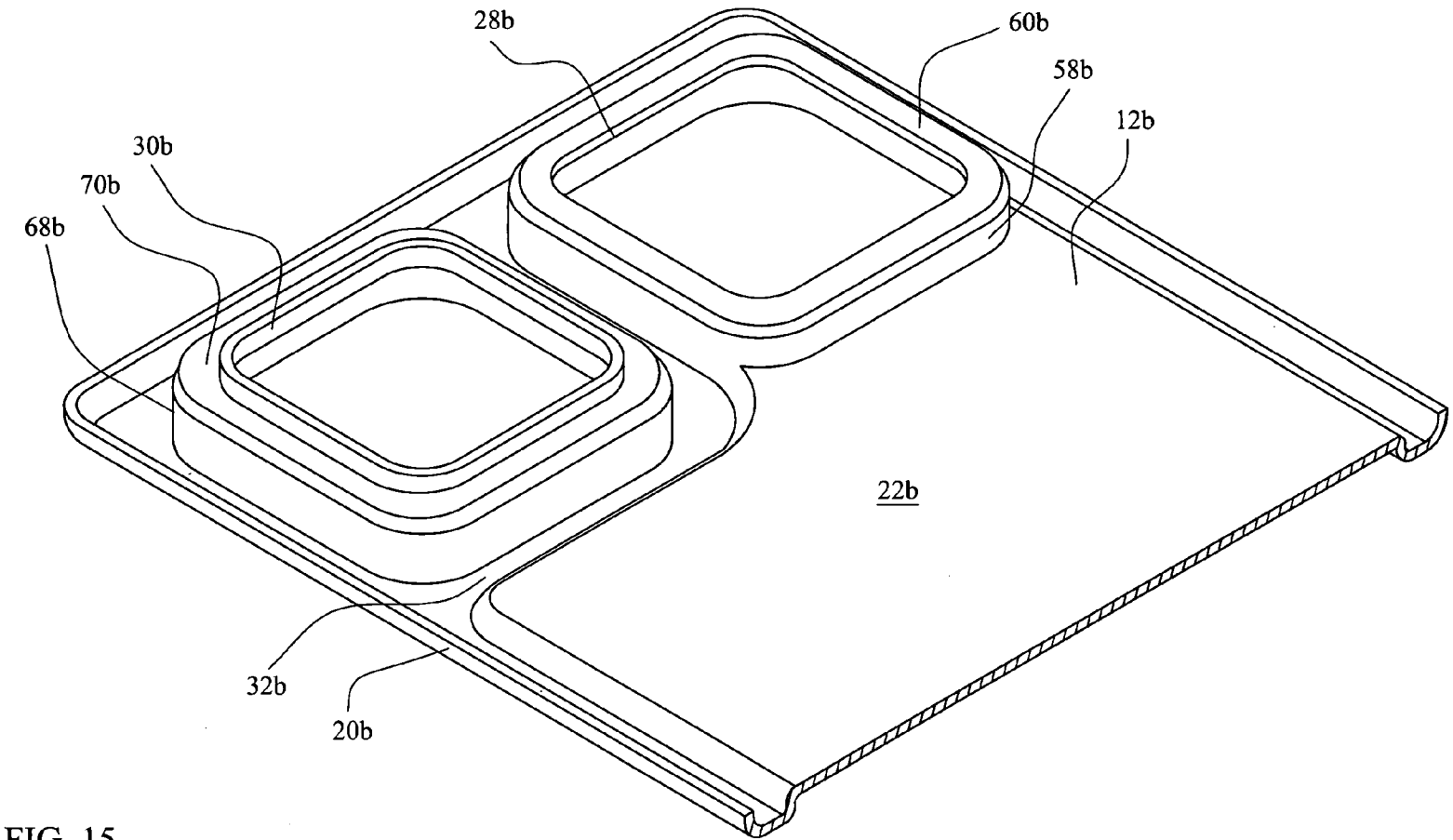
FIG. 15 is an enlarged view from FIG. 14 of a first end of the alternative first plate.

Referring now to FIGS. 2, 3, and 6–8, each of the first plates 12, 12*a* can include a first inlet aperture 28 and a first outlet aperture 30, 30*a* disposed on an opposite side of the respective first center portion 22, 22*a* relative to the respective first return aperture 26, 26*a*. Each of the first plates 12, 12*a* can also include a first inlet trough 58 recessed with respect to the respective first center portion 22, 22*a*. The first inlet aperture 28 can be disposed in a bottom 60 of the first inlet troughs 58. Each plate 12, 12*a* can also include a secondary inlet aperture 88. The secondary inlet 88 aperture can be disposed in a bottom of an inlet trough 86. Referring now to FIGS. 14 and 15, an alternative embodiment of a first plate 12*b* can include a peripheral lip 20*b*, a center portion 22*b*, a return aperture 26*b* disposed at the bottom 48*b* of an inlet trough 46*b*, and a single inlet aperture 28*b* disposed at the bottom 60*b* of an inlet trough 58*b*.

Referring now to FIGS. 2, 3, 8, 9, 12 and 13, each of the first plates 12, 12*a* can include a first outlet trough 68, 68*a* recessed with respect to the respective first center portion 22, 22*a*. The first outlet apertures 30, 30*a* can be individually defined in respective bottoms 70, 70*a* of the first outlet troughs 68, 68*a*. Referring now to FIGS. 14 and 15, the alternative embodiment of a first plate 12*b* can include an outlet aperture 30*b* defined in a bottom 70*b* of an outlet trough 68*b*.

Figure 3:
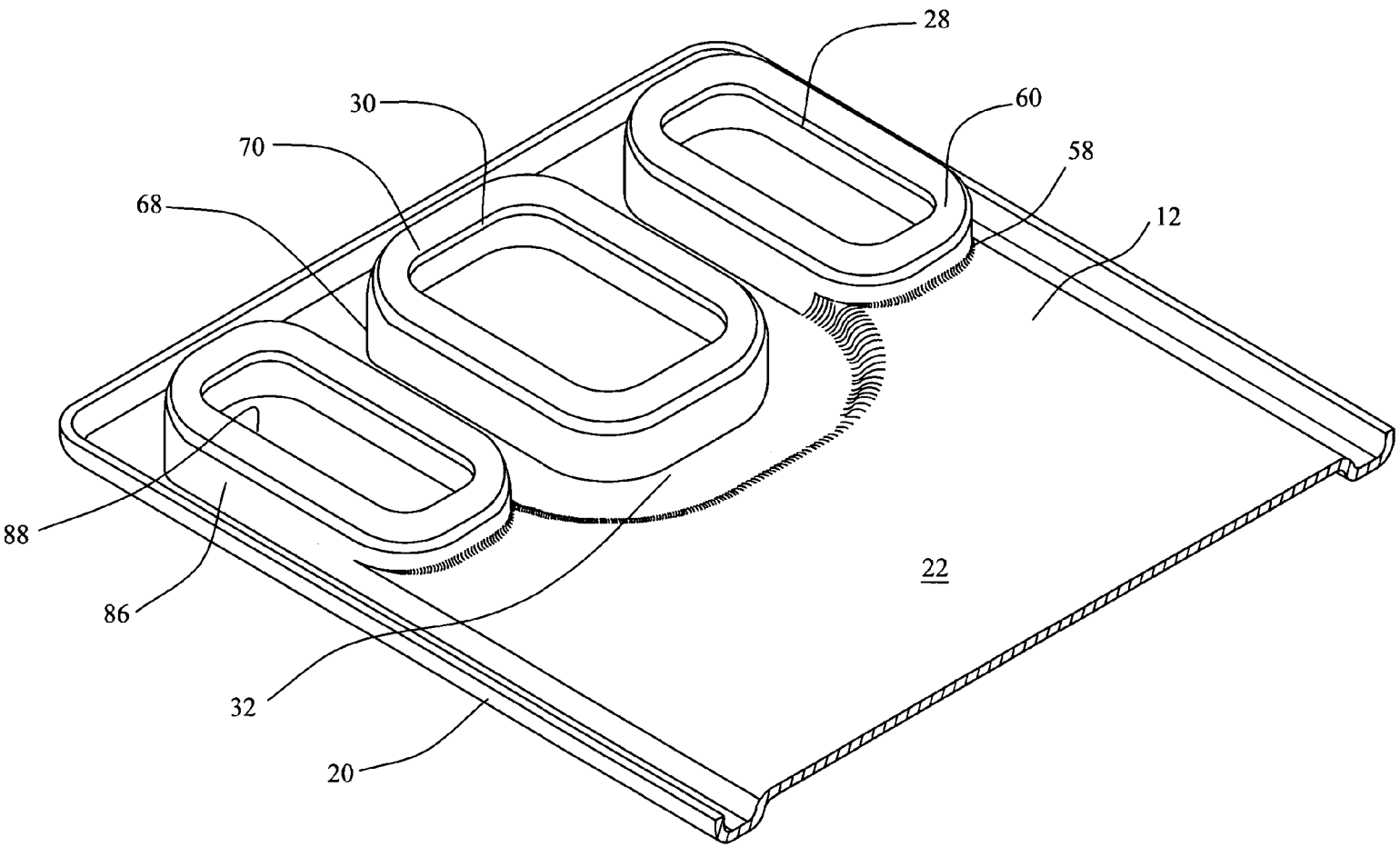
FIG. 3 is a enlarged view from FIG. 2 of a first end of the first plate.
Figure 9:
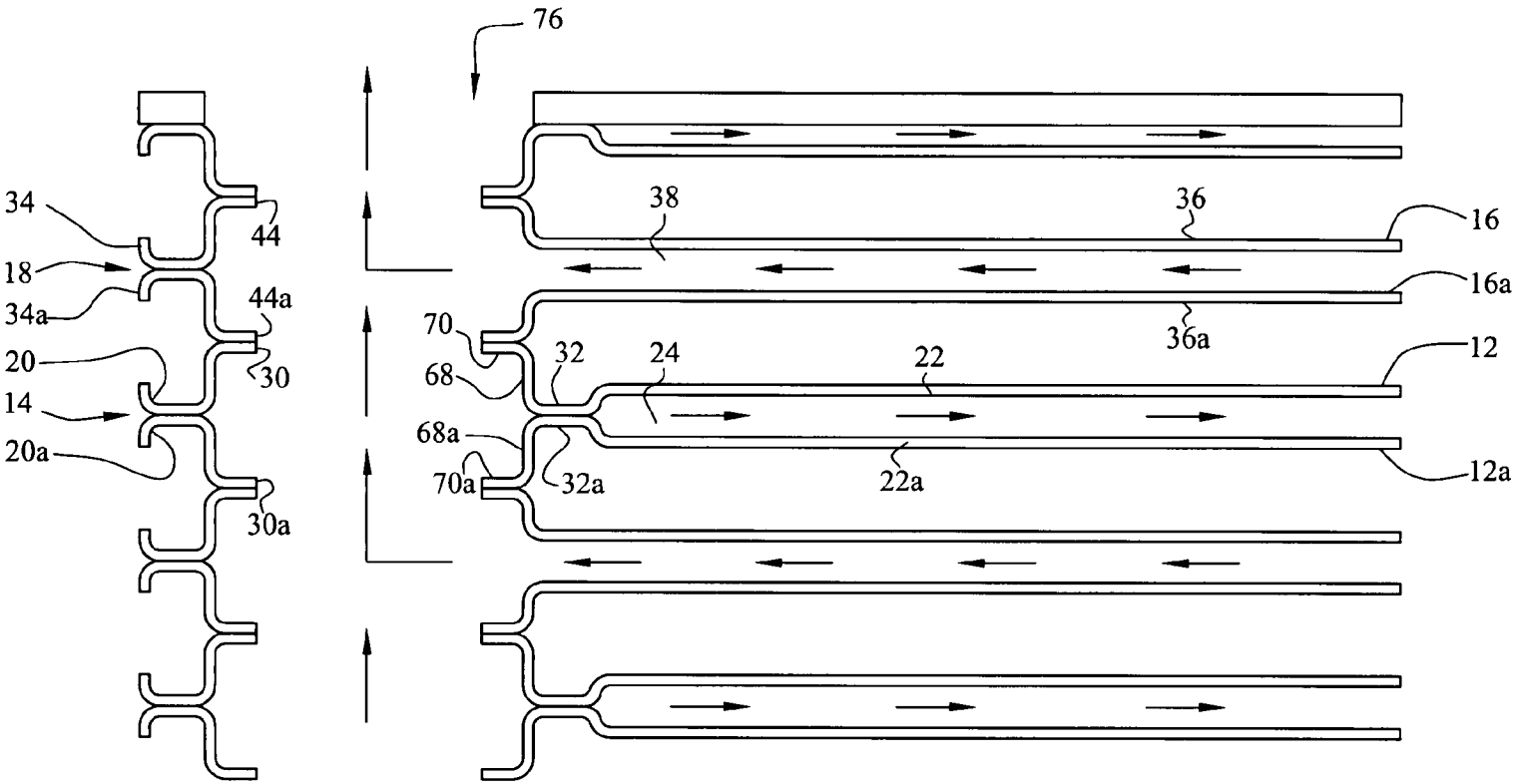
FIG. 9 is a side view of the cross-sectional view of FIG. 8.

Referring now to FIGS. 2, 3 and 9, each of the first plates 12, 12*a* can include mounds 32, 32*a* projecting from the respective first center portions 22, 22*a* and surrounding the respective outlet apertures 30, 30*a* and/or the troughs 68, 68*a*. The mounds 32, 32*a* of the two first plates 12, 12*a* of the first pair 14 can engage one another when the first pair 14 is formed. The mounds 32, 32*a* can be in sealing engagement with one another to isolate the aligned outlet apertures 30, 30*a* from the first cavity 24. Referring now to FIGS. 14 and 15, the alternative embodiment of a first plate 12*b* can include a mound 32*b* surrounding the outlet aperture 30*b*. The mound 32*b* can surround the trough 68*b*.

Figure 16:
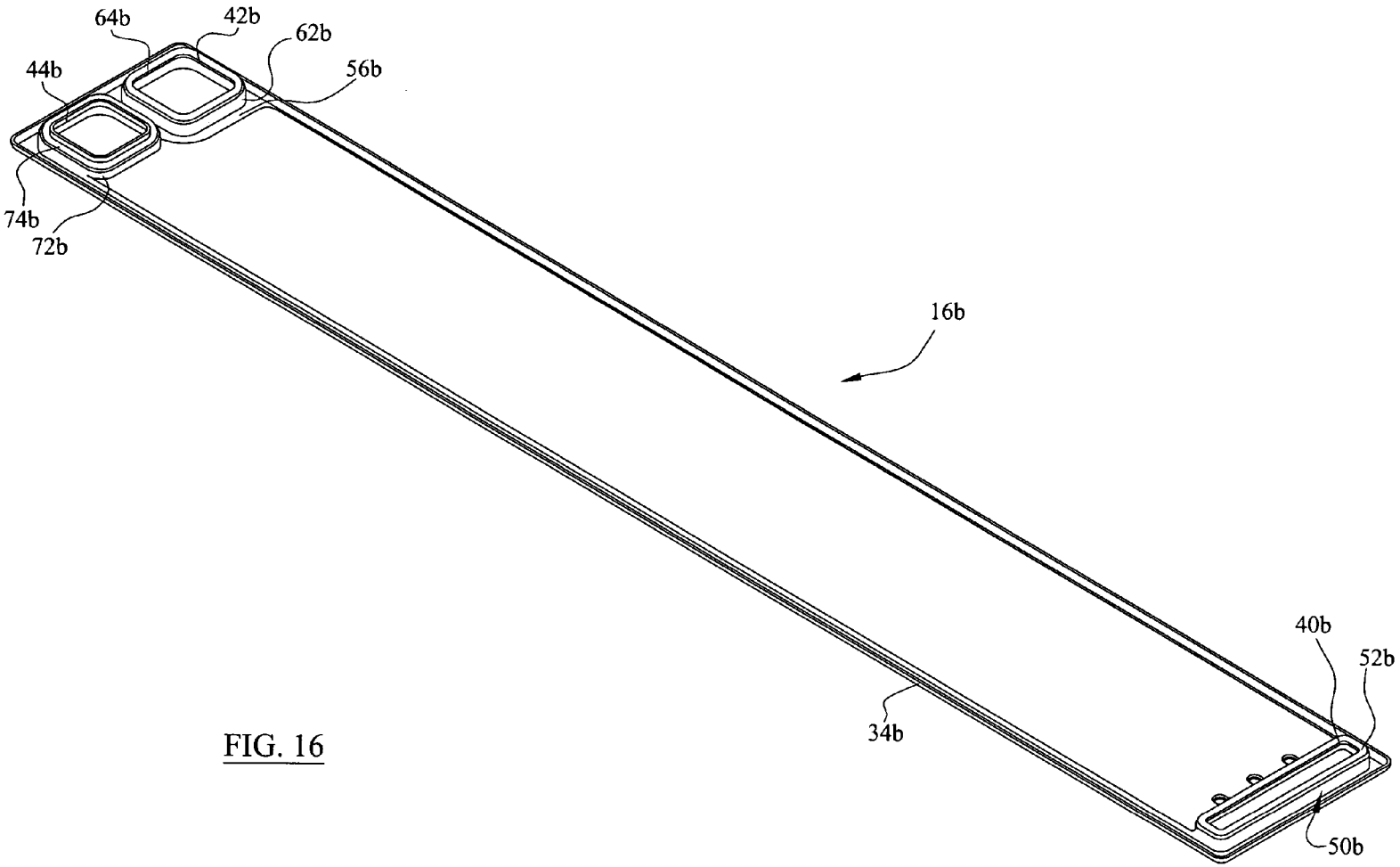
FIG. 16 is a perspective view of an alternative embodiment of the second plate.
Figure 17:
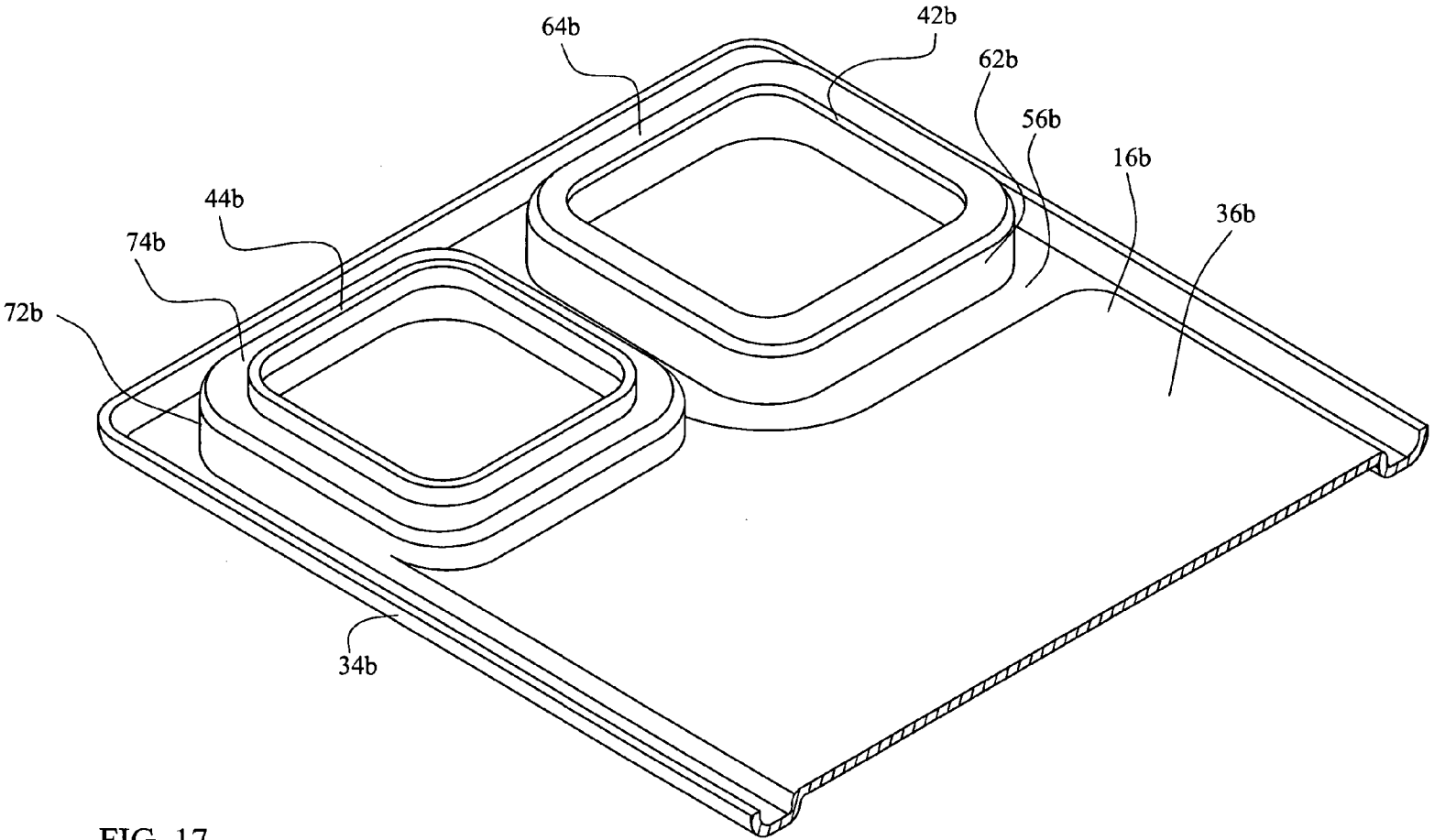
FIG. 17 is an enlarged view from FIG. 16 of a first end of the alternative second plate.

The second plates 16, 16*a* can be substantially similar to the first plates 12, 12*a*. Referring now to FIGS. 4, 5, 6 and 7, each of the second plates 16, 16*a* can include a second peripheral lip 34, 34*a* extending along the respective peripheries of the second plates 16, 16*a* and second center portions 36, 36*a* recessed with respect to the respective peripheral lips 34, 34*a*. The peripheral lips 34, 34*a* of said two second plates 16, 16*a* can engage one another when the second pair 18 is formed. The second center portions 36, 36*a* can be spaced apart from one another when the second pair 18 is formed to define a second cavity 38 between the plates 16, 16*a*. Referring now to FIGS. 16 and 17, an alternative embodiment of the second plate 16*b* can include a second peripheral lip 34*b* extending along the periphery of the second plate 16*b* and a second center portion 36*b* recessed with respect to the second peripheral lip 34*b*.

Referring now to FIGS. 4, 5 and 10–13, each of the second plates 16, 16*a* can also include a second return aperture 40, 40*a* adjacent to the respective second center portion 36, 36*a*. The second return apertures 40, 40*a*, can communicate with the second cavity 38. Each of the two second plates 16, 16*a* can also include a second return trough 50, 50*a* recessed with respect to the respective second center portion 36, 36*a*. The second return apertures 40, 40*a* can be individually disposed in respective bottoms 52, 52*a* of the second return troughs 50, 50*a*. Referring now to FIG. 16, the alternative embodiment of the second plate 16*b* can include a second return aperture 40*b* disposed at a bottom 52*b* of a return trough 50*b*.

Referring now to FIGS. 4–8, each of the second plates 16, 16*a* can include a second inlet aperture 42 and a second outlet aperture 44, 44*a* disposed on an opposite side of the respective second center portion 36, 36*a* relative to the second return apertures 40, 40*a*. Each plate 16, 16*a* can also include includes a second inlet trough 62 recessed with respect to the respective second center portion 36, 36*a*. The second inlet aperture 42 can be individually disposed in respective bottoms 64 of the second inlet trough 62. Each plate 16, 16*a* can also include a secondary inlet aperture 92. The secondary inlet aperture 92 can be disposed in a bottom of an inlet trough 90. Referring now to FIGS. 16 and 17, the alternative embodiment of the second plate 16*b* can include a single inlet aperture 42*b* disposed at a bottom 64*b* of an inlet trough 62*b*.

Referring now to FIGS. 4, 5, 8, 9, 12 and 13, each of the second plates 16, 16*a* can include a second outlet trough 72, 72*a* recessed with respect to the respective second center portion 36, 36*a*. The second outlet apertures 44, 44*a* can be individually disposed in respective bottoms 74, 74*a* of the second outlet troughs 72, 72*a*. Referring now to FIGS. 16 and 17, the alternative embodiment of the plate 16*b* can include a second outlet aperture 44*b* disposed in a bottom 74*b* of a second outlet trough 72*b*.

Figure 4:
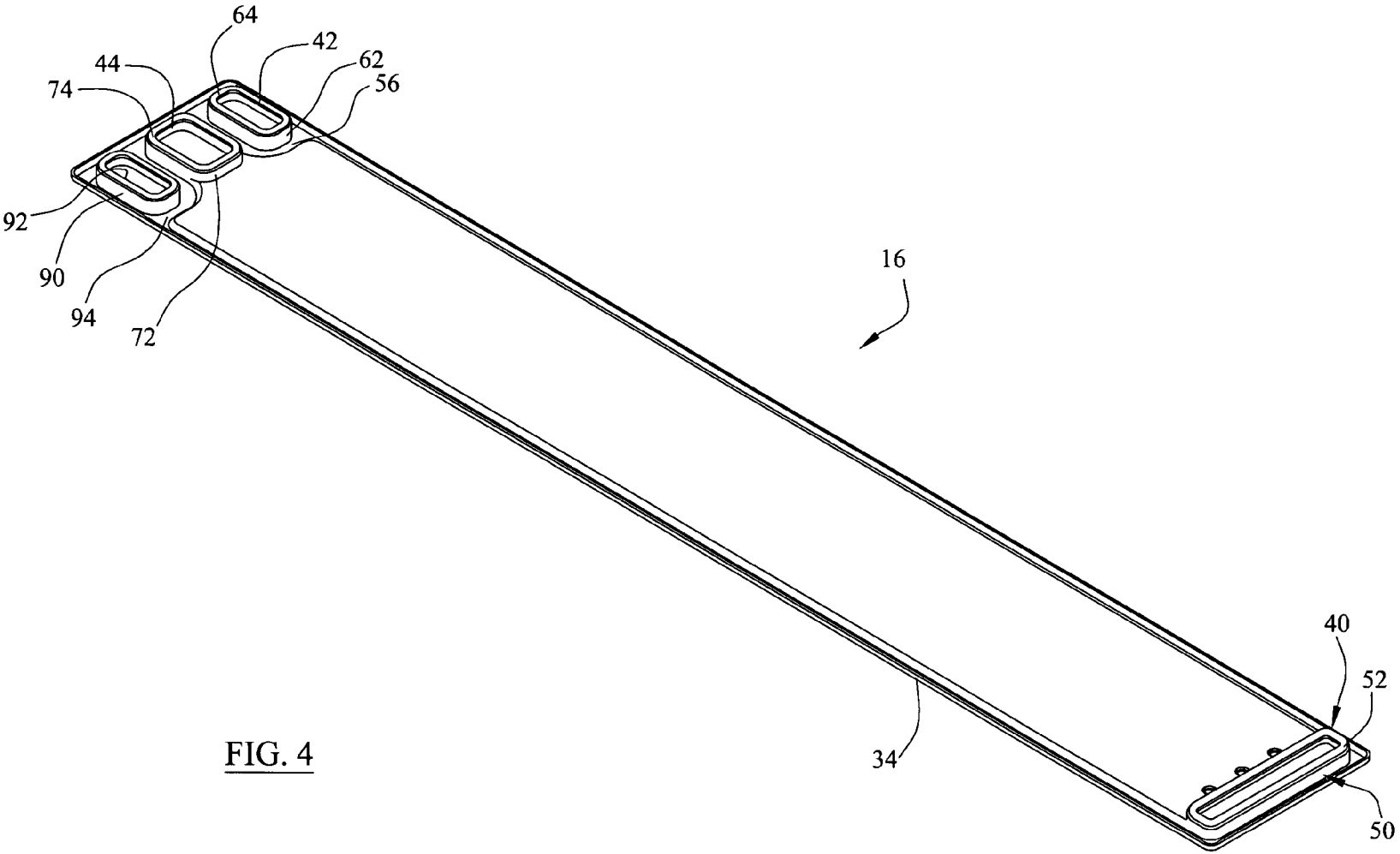
FIG. 4 is a perspective view of a second plate according to the invention.
Figure 5:
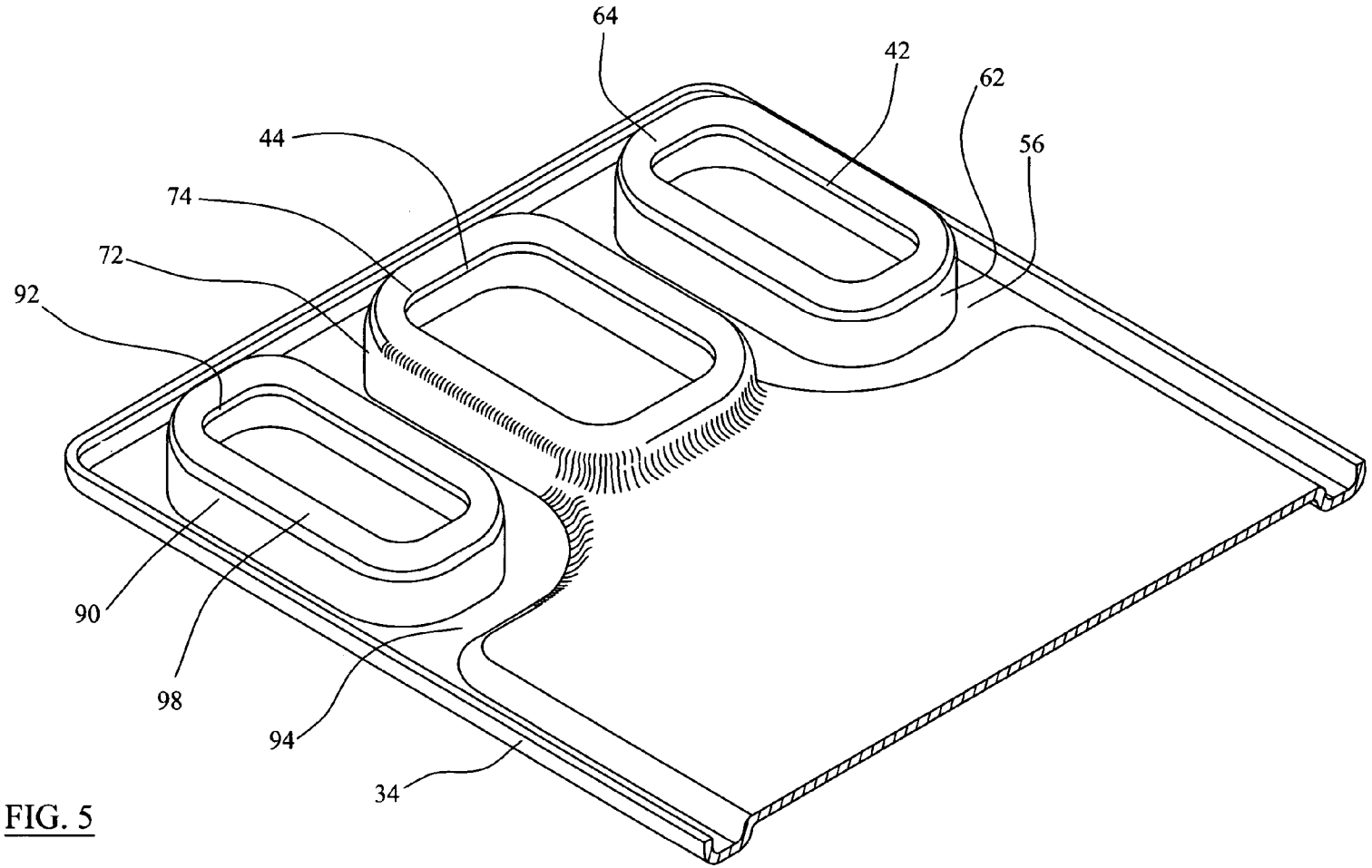
FIG. 5 is enlarged view from FIG. 4 of a first end of the second plate.
Figure 7:
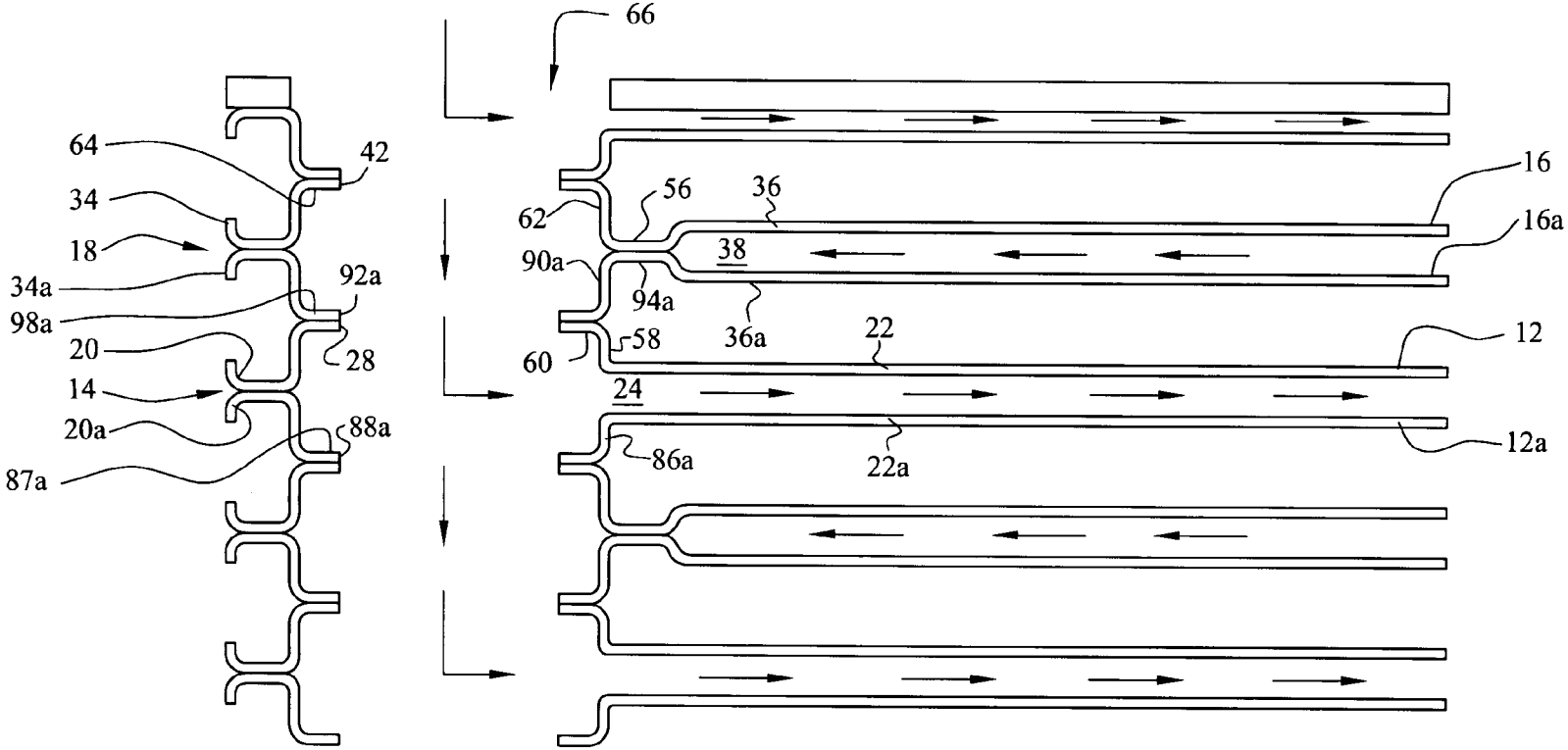
FIG. 7 is a side view of the cross-sectional view of FIG. 6.

Referring now to FIGS. 4, 5 and 7, each of the second plates 16, 16*a* can include a second mound 56 individually projecting from the respective second center portion 36, 36*a* and surrounding the respective second inlet aperture 42. The second plates 16, 16*a* also include a third mound 94 projecting from the respective second center portion 36, 36*a* and surrounding the secondary inlet aperture 92. As shown in the drawings, the mounds 56 and 94 can surround the troughs 62 and 90, respectively. When two second plates are engaged to form the pair 18, a mound 56 of the plate 16 is engaged with a mound 94*a* of the second plate 16*a* in response to the plates 16, 16*a* being in back-to-back, mirrored relation to one another. The engaged mounds 56, 94*a* can be in sealing engagement with one another to isolate the aligned apertures 42 and 92*a* from said second cavity (38). Mounds 56*a*, 94 can be in also be sealing engagement with one another to isolate the aligned apertures 42*a* and 92 from said second cavity (38).

Figure 13:
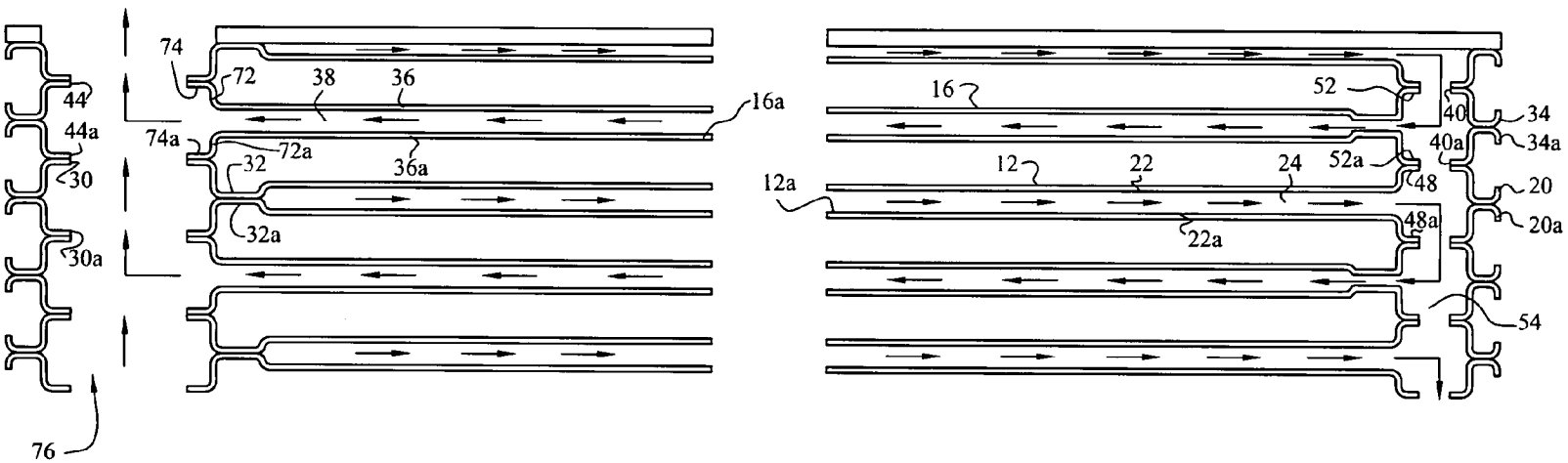
FIG. 13 is a side view of the cross-sectional view of FIG. 12.

A plurality of pairs 14 and 18 of plates can be stacked together to form the evaporator 10. Referring now to FIGS. 10, 11, and 13, the bottom 48 of the first return trough 46 can cooperate in sealing engaging with the bottom 52*a* of the second return trough 50*a* when the pairs 14, 18 are stacked together. The return apertures 26, 26*a*, 40, 40*a* of the plates 12, 12*a*, 16, 16*a* can be aligned in response to stacking to define a return tank 54 in communication with the first and second cavities 24, 38. The return tank 54 can be in fluid communication with all of the cavities formed by the evaporator 10.

Figure 8:
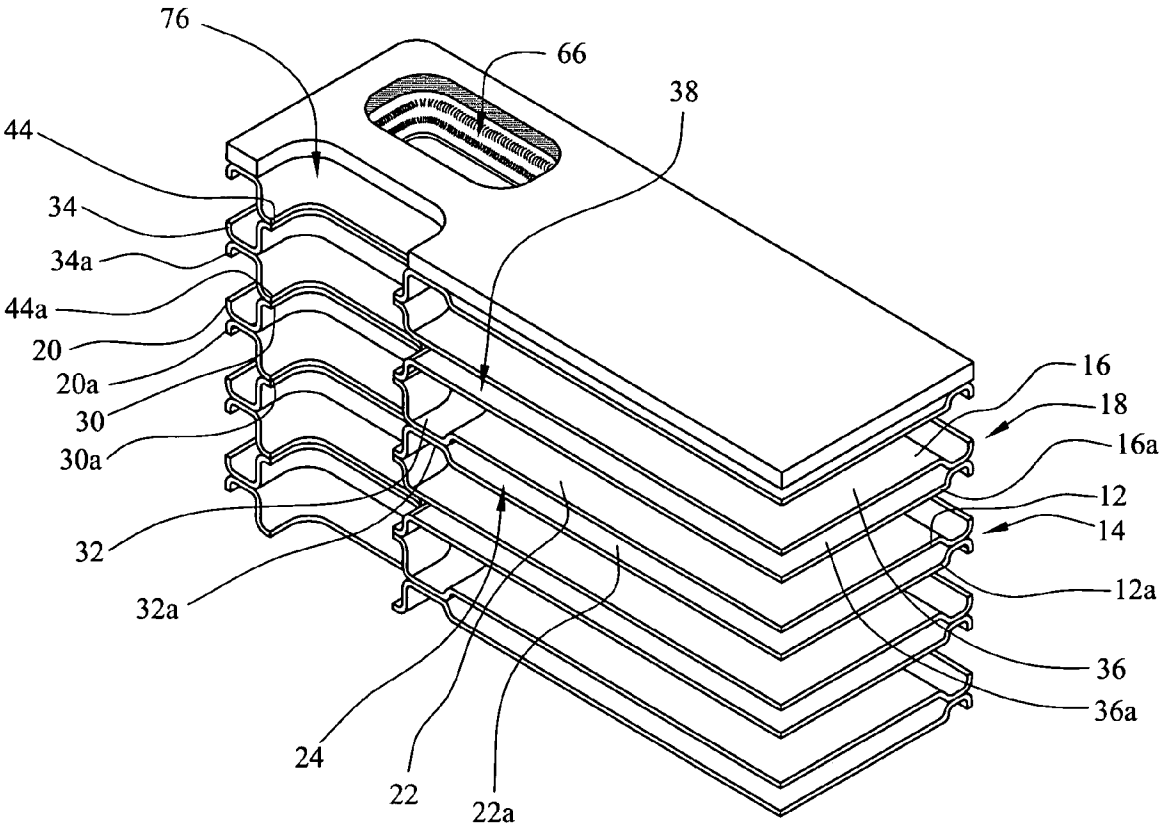
FIG. 8 is a perspective, staggered cross-sectional view of the evaporator shown in FIG. 1, the cross-section taken along the outlet manifold.

Referring now to FIGS. 8, 9 and 13, the bottom 70 of the first outlet trough 68 can cooperate in sealing engaging with the bottom 74*a* of the second outlet trough 72*a* between adjacent plates 12, 16*a* of the pairs 14, 18. The outlet apertures 30, 30*a*, 44, 44*a* of the plates 12, 12*a*, 16, 16*a* can be aligned in response to stacking to define a outlet manifold 76 in communication with only the second cavity 38 relative to the first and second cavities 24, 38.

Referring now to FIG. 7, the bottom 60 of the inlet trough 58 can cooperate in sealing engaging with the bottom 98*a* of the inlet trough 90*a* between adjacent plates 12, 16*a* of adjacent pairs 14 and 18. The inlet apertures 28, 42, 88*a*, 92*a* of the plates 12, 12*a*, 16, 16*a* can be aligned in response to stacking to define an inlet manifold 66 in communication with only the first cavity 24 relative to the first and second cavities 24, 38. A similar, corresponding second inlet manifold 96 can be defined by aligned apertures on an opposite side of the outlet manifold 76.

Figure 18:
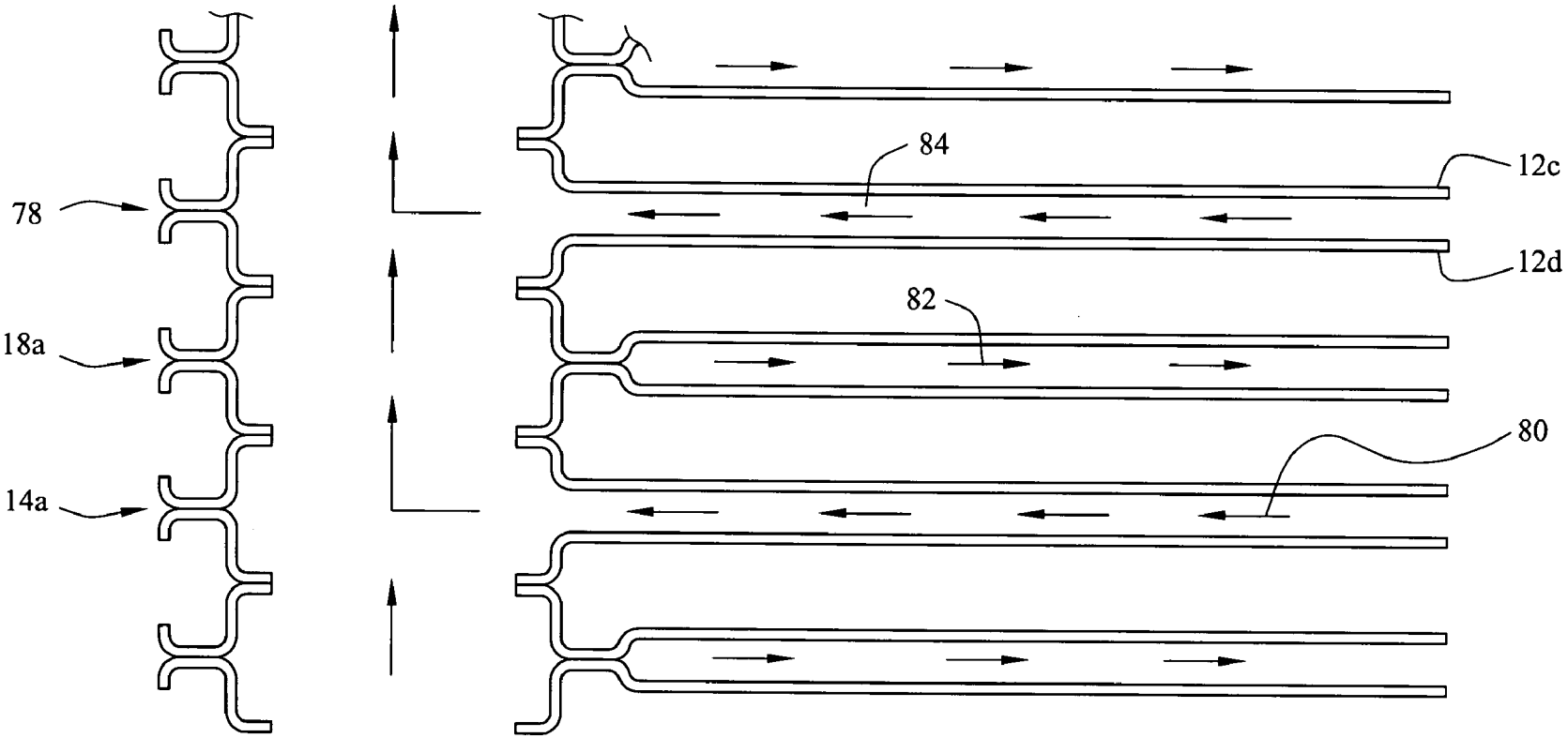
FIG. 18 is a cross-sectional view of an embodiment of the invention showing fluid pathways arranged in an alternating pattern.

Referring now to FIG. 18, a plurality of pairs 14, 18 can be stacked in an alternating pattern. For example, a pair 18*a* can be positioned between first pair 14*a* and a third pair 78. The pair 78 can be identical to the pair 14*a*. Each pair 14, 14*a*, 18, 18*a*, 78 shown in the several Figures can define a cavity, such as cavities 24 and 38, between opposing plates 12, 12*a*, 12*b*, 12*c*, 12*d*, 16*a*, 16*d*. A fluid stream can be directed through the evaporator 10 be directed through the cavities defined by the various pairs 14, 14*a*, 18, 18*a*, 78 of opposing plates 12, 12*a*, 12*b*, 12*c*, 12*d*, 16*a*, 16*d*. Fluid streams can be directed in opposite directions along the height of the stack of the evaporator 10. For example, a first fluid stream 80 can move in a first direction. A second fluid stream 82 can move in a second direction. A third fluid stream 84 can move in the first direction. The second fluid stream 82 can be disposed between the first and third fluid streams 80, 84.

In operation, a stream of fluid to be evaporated can be directed into inlet manifolds 66, 96 of the evaporator 10. The stream can be divided into sub-streams; each sub-stream passing from the inlet manifolds 66, 96 to cavities 24 defined between first plates 12, 12*a* disposed in back-to-back mirrored relationship with one another. The sub-streams can be rejoined at the return tank 54 and re-divided to move into cavities 38 defined between second plates 16, 16*a* disposed in back-to-back mirrored relationship with one another. The sub-streams can be rejoined in the outlet manifold 76 and the fluid stream can evacuate the evaporator 10.

The exemplary embodiment of the invention provides numerous advantages over the prior art. For example, the invention provides Improved Temperature Uniformity of Evaporator Discharge Air. Automotive evaporators operate such that they are not completely "flooded" with refrigerant. This means that somewhere toward the end of the refrigerant flow path, the refrigerant is completely evaporated. From this "dry point" to the outlet of the evaporator exists a region where the refrigerant is superheated. This superheated region of the evaporator becomes an area that that doesn't much cool the air flowing through it and thus results in a "hot spot" at air discharge face of the evaporator. Further, in recent years, automotive trend is away from Orifice Tube expansion devices toward Thermal Expansion Valves, which results in higher levels of superheat, thus aggravating the temperature uniformity issue. This invention, through it's alternating refrigerant flow arrangement, isolates these "hot spots" to a number of smaller areas instead of one bigger area, each surrounded by cold, flooded (inlet) evaporator tubes so that the resulting mixed air at the evaporator outlet is not so hot.

Furthermore, the invention provides improved Cooling Capacity. With this invention, each particle of refrigerant makes only two passes through the evaporator vs. the more typical four or more passes on conventional evaporators. This should lower the refrigerant side pressure drop. And, since in the evaporator, refrigerant exists in the 2-phase state (except for superheated region), and since, the refrigerant temperature depends directly on the refrigerant pressure in the 2-phase state, this lower pressure drop directly affects the temperature of the refrigerant and thus it's capacity to cool and dehumidify the air. To explain further, since the pressure at the outlet of the evaporator is more or less fixed by the refrigerant controls to keep the evaporator from getting too cold and "freezing up", the lower pressure drop evaporator keeps the evaporator at a lower "mean evaporating temperature and pressure" therefore enhancing Cooling Capacity. There is another feature of this invention that similarly can enhance Cooling Capacity. Typical evaporators have identical individual refrigerant flow passages (tubes) in the evaporator. But since the refrigerant is evaporating, and thus increasing it's volumetric flow rate, as it flows through the evaporator, the ideal situation is to have an increasing area in the refrigerant flow direction—to reduce pressure drop. Since in this invention, the alternating passages can be different—one internal tube height for "inlet" tubes and another, larger, for "outlet" tubes—this feature also can reduce the refrigerant side pressure drop and enhance Cooling Capacity. Conventional evaporators accomplish this by varying the number of individual tubes in each refrigerant pass, a different technique than the feature of the invention just described.

Furthermore, the invention provides improved Noise characteristics. It is well known that if air side pressure drop can be reduced, then noise can be reduced since fan power is reduced. One way air side pressure drop can be reduced, for any given evaporator size (exterior dimensions) is to increase the proportion of the face area open to the air flow. This invention can enhance this is two ways. The first is that, the smaller return manifold mentioned above that this alternating flow idea allows, means that less of the total face area normal to the flow of the air is blocked, allowing reduction in pressure drop. The second is that since, as mentioned above, the inlet tubes can be made smaller in height than the outlet tubes this smaller tube height creates less blockage to the air flow (in this case the invention allows the choice of also reducing air side pressure drop instead of refrigerant pressure drop or in any combination that optimizes the two for any specific application).

Furthermore, the invention provides improved environmental characteristics. It has already been mentioned above that air side and refrigerant side pressure drop can be reduced with this invention. This also reduces power consumption and thus increases the efficiency of the air conditioning unit. Additionally, however, the ability to decrease the height of the refrigerant tubes can reduce the internal volume (refrigerant side volume) of the evaporator, thus allowing a modest reduction in the "charge" of refrigerant required for the vehicle air conditioning unit. This is a mass savings for the vehicle, and further, could be advantageous if the usage of refrigerant were to some day be limited due to environmental issues.

Furthermore, the exemplary embodiment of this invention is of simple construction. The tube plates can be die struck and these tube plates form the manifolds and even can form the refrigerant control orifices in the manifolds, if needed. Contrast this with the recently introduced compact evaporators that have good temperature uniformity. These have two rows of extruded tubes, separate manifolds that are not common, and even have separate orifice pieces that must be placed in the manifolds. The potential refrigerant charge reduction mentioned above is also a direct cost reduction.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An evaporator comprising:

a first plate having a first configuration including a first peripheral lip extending along the periphery of said first plate, a first center portion recessed with respect to said lip and having first and second ends, and a width, a first return trough recessed with respect to said center portion and having a first return aperture positioned at a bottom of said first return trough, first and second inlet troughs adjacent said second end and recessed with respect to said center portion with inlet apertures disposed in each inlet trough, a first outlet trough disposed between said first and second inlet troughs and recessed with respect to said center portion with an outlet aperture disposed in said outlet trough, and a first mound projecting from said center portion and surrounding said outlet trough;

a second plate having a second configuration including a second peripheral lip extending along the periphery of said second plate, a second center portion recessed with respect to said second lip and having third and fourth ends, and a second width, a second return trough recessed with respect to said second center portion and having a second return aperture positioned at a bottom of said second return trough, third and fourth inlet troughs adjacent said fourth end and recessed with respect to said second center portion with inlet apertures disposed in each inlet trough, a second outlet trough disposed between said third and fourth inlet troughs and recessed with respect to said second center portion with a second outlet aperture disposed in said second outlet trough, a second mound projecting from said second center portion and surrounding said third inlet trough, and a third mound projecting from said second center portion and surrounding said fourth inlet trough, wherein said first and second configurations are differently shaped from one another;

a pair of first plates disposed in a back to back mirrored relationship to one another with said peripheral lips thereof engaging one another and said first mounds thereof engaging one another, whereby said return apertures, said inlet apertures and said outlet apertures thereof are aligned;

a pair of second plates disposed in a back to back mirrored relationship to one another with said peripheral lips thereof engaging one another and said second and third mounds thereof engaging one another, whereby said return apertures, said inlet apertures and said outlet apertures thereof are aligned; and said pairs being alternatingly stacked with respect to one another with said first and second return troughs engaging one another whereby said return apertures are aligned to define a return tank, said inlet troughs engaging one another whereby said inlet apertures are aligned to define a first and second inlet manifolds, and said outlet troughs engaging one another whereby said outlet apertures are aligned to define an outlet manifold, and whereby said center portions of said pair of first plates are spaced apart to define a fluid pathway communicating with the return tank and the first and second inlet manifolds and said center portions of said pair of second plates are spaced apart to define a fluid pathway communicating with the return tank and the outlet manifold.

2. An evaporator for evaporating a fluid and cooling air flowing through said evaporator, said evaporator comprising:

two first plates, each having a first configuration, engaged in a back to back mirrored relationship to one another to form a first pair with a first cavity defined between said two first plates;

two second plates, each having a second configuration, engaged in a back to back mirrored relationship to one another to form a second pair with a second cavity defined between said two second plates;

wherein said first pair of plates and said second pair of plates are stacked together;

an inlet manifold defined in said first and second pairs of plates for receiving the fluid to be evaporated, said inlet manifold in communication with only said first cavity relative to said first and second cavities for directing the fluid through said evaporator in a first direction;

a return tank defined in said first and second pairs of plates opposite said inlet manifold, said return tank in communication with said first cavity for receiving the fluid from said first cavity and in communication with said second cavity for directing the fluid through said evaporator in a second direction opposite said first direction; and an outlet manifold defined in said first and second pairs of plates opposite said return tank and adjacent said inlet manifold, said outlet manifold in communication with only said second cavity relative to said first and second cavities for evacuating the fluid from said second cavity out of said evaporator.

3. The evaporator of claim 2 further comprising a second inlet manifold defined in said first and second pairs of plates adjacent said inlet manifold on an opposite side of said outlet manifold for receiving the fluid to be evaporated, said second inlet manifold in communication with only said first cavity relative to said first and second cavities for directing the fluid through said evaporator in said first direction.

4. The evaporator of claim 2 wherein each of said two first plates includes a first peripheral lip extending along the periphery of said first plate and a first center portion recessed with respect to said peripheral lip, said peripheral lips of said two first plates engage one another, whereby said center portions are spaced apart from one another defining said first cavity therebetween.

5. The evaporator of claim 4 wherein each of said two first plates includes a first inlet aperture defining said inlet manifold, and wherein each of said two first plates includes a first outlet aperture defining said outlet manifold.

6. The evaporator of claim 5 wherein each of said two first plates includes a first return aperture defining said return tank.

7. The evaporator of claim 6 wherein each of said two first plates includes at least one mound projecting from said first center portion and surrounding one of said first inlet aperture and said first outlet aperture, said mounds of said two first plates of said first pair engage one another, whereby said one aperture surrounded by said mound is isolated from said first cavity.

8. The evaporator of claim 6 wherein each of said two second plates includes a second peripheral lip extending along the periphery of said second plate and a second center portion recessed with respect to said second peripheral lip, said peripheral lips of said two second plates engaged with one another, whereby said second central portions are spaced apart from one another defining a second cavity therebetween, each of said two second plates also including a second return aperture adjacent said second center portion, said second return apertures communicating with said second cavity, each of said two second plates also including a second inlet aperture and a second outlet aperture disposed on an opposite side of said second center portion relative to said second return aperture.

9. The evaporator of claim 8 wherein:

each of said two first plates includes a first return trough recessed with respect to said first center portion, said first return aperture disposed at a bottom of said first return trough; and each of said two second plates includes a second return trough recessed with respect to said second center portion, said second return aperture disposed at a bottom of said second return trough, said bottom of said first return trough engaging said bottom of said second return trough between adjacent pairs of plates, whereby said return apertures of the plates are aligned to define a return tank in communication with the first and second cavities.

10. The evaporator of claim 9 wherein:

each of said two first plates includes a first mound projecting from said first center portion and surrounding said first outlet aperture, said first mounds of said two first plates engaged with one another, whereby said first outlet aperture is isolated from said first cavity; and each of said two second plates includes a second mound projecting from said second center portion and surrounding said second inlet aperture, said second mounds of said two second plates engaged with one another, whereby said second inlet aperture is isolated from said second cavity.

11. The evaporator of claim 10 wherein:

each of said two first plates includes a first inlet trough recessed with respect to said first center portion, said first inlet aperture disposed at a bottom of said first inlet trough; and each of said two second plates includes a second inlet trough recessed with respect to said second center portion, said second inlet aperture disposed at a bottom of said second inlet trough, said bottom of said first inlet trough engaging said bottom of said second inlet trough between adjacent pairs of plates, whereby said inlet apertures of the plates are aligned to define an inlet manifold in communication with only the first cavity relative to the first and second cavities.

12. The evaporator of claim 10 wherein:

each of said two first plates includes a first outlet trough recessed with respect to said first center portion, said first outlet aperture disposed at a bottom of said first outlet trough; and each of said two second plates includes a second outlet trough recessed with respect to said second center portion, said second outlet aperture disposed at a bottom of said second outlet trough, said bottom of said first outlet trough engaging said bottom of said second outlet trough between adjacent pairs of plates, whereby said outlet apertures of the plates are aligned to define a outlet manifold in communication with only the second cavity relative to the first and second cavities.

13. The evaporator of claim 2 further comprising a third pair of plates formed with said two first plates engaged in a back to back mirrored relationship to one another, said third pair stacked with said first and second pairs such that said second pair is disposed between said first and third pairs.

14. The evaporator of claim 2 wherein said first and second configurations are differently shaped from one another.

* * * * *